US006080978A

United States Patent [19]

Blaker et al.

[11] Patent Number: 6,080,978

[45] Date of Patent: Jun. 27, 2000

[54] DIELECTRIC DRYING KILN MATERIAL HANDLING SYSTEM

[75] Inventors: Glenn Craig Blaker, North Vancouver; Terry Albert Enegren; Yiu Kwan Ho, both of Vancouver; Gary Kenneth Kooznetsoff; Robert Lewis Zwick, both of Castlegar, all of Canada

[73] Assignee: HeatWave Drying Systems Ltd., Crescent Valley, Canada

[21] Appl. No.: 09/161,396

[22] Filed: Sep. 28, 1998

[51] Int. Cl.[7] ..... H05B 6/54

[52] U.S. Cl. ..... 219/775; 219/778; 219/780; 34/250; 34/257

[58] Field of Search ..... 219/780, 778, 219/775, 774, 776, 773, 764, 770; 34/250, 255, 257

[56] References Cited

U.S. PATENT DOCUMENTS

| | | | |
|---|---|---|---|
| 2,674,050 | 4/1954 | Pound | 219/775 |
| 2,737,569 | 3/1956 | Brown et al. | 219/775 |
| 2,779,848 | 1/1957 | Bosomworth et al. | 219/776 |
| 3,986,268 | 10/1976 | Koppelman . | |
| 4,316,709 | 2/1982 | Peterson et al. | 219/773 |
| 4,466,198 | 8/1984 | Doll | 34/251 |
| 4,472,618 | 9/1984 | Cloer . | |
| 4,974,503 | 12/1990 | Koch | 219/776 |

*Primary Examiner*—Philip H. Leung

*Attorney, Agent, or Firm*—C. A. Rowley

[57] ABSTRACT

A dielectric drying kiln material handling system includes a bottom electrode incorporating a conveyor system for moving material along said bottom electrode for moving material on and off of the electrode. Conveyors are built into the electrode in a manner so that the electrode surface of the bottom electrode, i.e. the surface contacting material to be dried is configured with gaps having dimensions so that the gaps do not significantly affect the uniformity of the power distribution over the electrode surface. Various types of conveyors may be used such as slat conveyors, roller conveyors, belt conveyors and the like provided the gaps, i.e. between the slats receiving the rollers or for accommodating the return rollers belt type conveyor are configured with dimensions so that the gaps do not significantly affect the uniformity of electromagnetic field and power distribution over the effective surface of the bottom electrode. The preferred arrangement permits computer control and includes an infeed conveyor, a electrode conveyor and an outfeed conveyor arranged in series so that material to be dried is positioned on the infeed conveyor and fed into the kiln with the feed forward of the infeed conveyor correlated with that of the electrode conveyor to deliver the material to be dried into position onto the electrode conveyor and then after drying, electrode conveyor is correlated with the outfeed conveyor to move the material from the electrode conveyor onto the outfeed conveyor. Preferably, the infeed conveyor delivers material into the kiln at the same time as the outfeed conveyor is receiving material being expelled from the kiln.

20 Claims, 8 Drawing Sheets

DIELECTRIC DRYING KILN MATERIAL HANDLING SYSTEM

FIELD OF INVENTION

The present invention relates to an improved dielectric drying kiln material handling system, more particularly, the present invention relates to a dielectric drying kiln material handling system that permits computer control of the load handling cycle.

BACKGROUND OF THE INVENTION

Uses of dielectric heating/drying systems are known and are currently in use or have been proposed for use in agriculture, polymer manufacture, pharmaceuticals, bulk powder, food processing, wood products and other industries. One of the key industries using these dielectric heating/drying systems is the wood products industry and the present invention will be described particularly with respect to the wood products industry, although the invention, with suitable modifications where required, may be applied in the other industries in which dielectric heating/drying is to be performed.

In dielectric drying or heating systems particularly those used for drying wood, it is the conventional practice to load the material to be dried onto a wheeled cart and to roll the loaded cart into the kiln which is provided with rails to receive the wheels of the cart. See for example, U.S. Pat. No. 3,986,268 issued Oct. 19, 1976 to Koppelman and U.S. Pat. No. 4,472,618 issued Sep. 18, 1984 to Cloer. In these systems, the carts serve as both a conveyor and electrode. Clearly the cart which is the electrode is moveable and thus the cart-electrode must be moved into the kiln and connected electrically before the kiln chamber is closed and the drying process proceeds.

The combination of dielectric heating and the maintenance of sub-atmospheric pressure within the kiln permits extremely short drying times for lumber and other products and generally has high energy efficiency and can produce excellent dried product quality. These short drying cycles necessitate more frequent kiln loading and unloading. Cart-type handling systems in dielectric drying kilns such as that disclosed by Koppelman, though adequate, do not lend themselves to more rapid loading and unloading nor does it facilitate automatic handling or operation of the kiln.

As above indicated, all of these cart systems require manually connecting the grounding system to the cart loaded with material to be dried and positioned in the kiln before the drying cycle may be started and disconnecting the grounding system after drying and before the loaded cart may be moved from the kiln. This loading and unloading, connecting and disconnecting etc., necessitates the use of professionally trained personnel both for safety and operating procedures to better ensure there are no major problems or accidents. These limitations imposed primarily by the use of carts have given the process of dielectric drying a reputation as being non-robust in that it requires flimsy attachments which lead those in the lumber industry to imply that the technique is still in the research or experimental stage and has not yet been developed for commercial industrial purposes.

U.S. Pat. No. 3,986,268 issued Oct. 19, 1976 to Koppelman recognized the problem of carts and in one embodiment employs vertical electrodes and uses a conveyor (roller conveyor) to deliver the load to be dried into position between the vertical electrodes and then after drying to convey the dried load from between the electrodes. This system could permit computer-controlled operation, however it was found that uniform contact of the vertical electrodes with the sides of the load was difficult and could not consistently made whereby the effectiveness of the system was compromised.

BRIEF DESCRIPTION OF THE PRESENT INVENTION

It is an object of the present invention to provide an improved dielectric drying kiln material handling system to replace known transport systems.

It is a further object of the present invention to provide improved dielectric drying kiln material handling system that permits computer controlled loading and unloading in a cost effective manner.

Broadly, the present invention relates to a dielectric drying kiln including a bottom electrode and a top electrode each having a substantially horizontal load supporting electrode surface, said electrodes being vertically spaced to receive material to be dried therebetween, a conveyor system for moving material into and out of said kiln, said conveyor system including an infeed conveyor at one end of said kiln and outfeed conveyor at the other end of said kiln, said bottom electrode incorporating a conveyor having material moving elements operable to move said material along said load supporting electrode surface of said bottom electrode, said conveyor forming gaps in said load supporting electrode surface of said bottom electrode, said gaps being configured with dimensions selected so that said gaps do not significantly affect the uniformity of electromagnetic field and power distribution over said load supporting electrode surface of said bottom electrode during the application of dielectric power to said material during drying.

Preferably, said conveyor is a slat-type conveyor wherein a plurality of side-by-side slats having upper surfaces that form portions of said load supporting electrode surface of said bottom electrode, each said slat having a longitudinal axis substantially parallel to the direction of travel of said material through said kiln.

Preferably, alternate slats of said side-by-side slats are mounted for movement to an elevated conveying position, then in said direction of movement, then to a retracted position and then back to the starting position to intermittently move said material along said surface.

Preferably, said gaps are formed between adjacent of said slats and upper edges of said gaps formed at said load contacting electrode surface are filleted with a radius of at least 0.35 cm.

Preferably, said conveyor is a roller-type conveyor formed by a plurality of spaced rollers having their longitudinal axes substantially perpendicular to the longitudinal axis of said kiln, slots in said bottom electrode one to receive each of said rollers, each of said rollers being movable mounted in its said slot for movement between a retracted position with said roller positioned below load supporting electrode surface of said bottom electrode and an active position with at least a portion of the periphery of said rollers above said load supporting electrode surface for transport of material along said bottom electrode between said infeed and said other conveyor.

Preferably said load supporting electrode surface directly contacts said load during said drying.

Preferably, said conveyor comprises a flight-type conveyor formed from a plurality of side-by-side conveying elements with planer support surfaces, links interconnecting said conveying elements to form said flight type conveyor, said planer support surfaces being positioned in side-by-side relationship and forming a said load contact electrode surface of said bottom electrode with said gaps formed between adjacent said planer support surfaces.

Preferably, said conveyor comprises a belt-type conveyor extending substantially the full length of said bottom electrode and where belt receiving slots are provided through said bottom electrode adjacent to each longitudinal end of said bottom electrode to receive belt means of said belt type conveyor, said belt means extending along the upper surface of said supporting electrode surface of said bottom electrode between an input and output end of said bottom electrode, rollers positioned in said belt receiving slots to direct said belt means through it said belt receiving slot, and return rollers below said bottom electrode to direct said belt means between said belt receiving slots.

Preferably said kiln is provided with vacuum generating means for reducing the pressure in said kiln during said drying to a pressure below atmospheric pressure.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
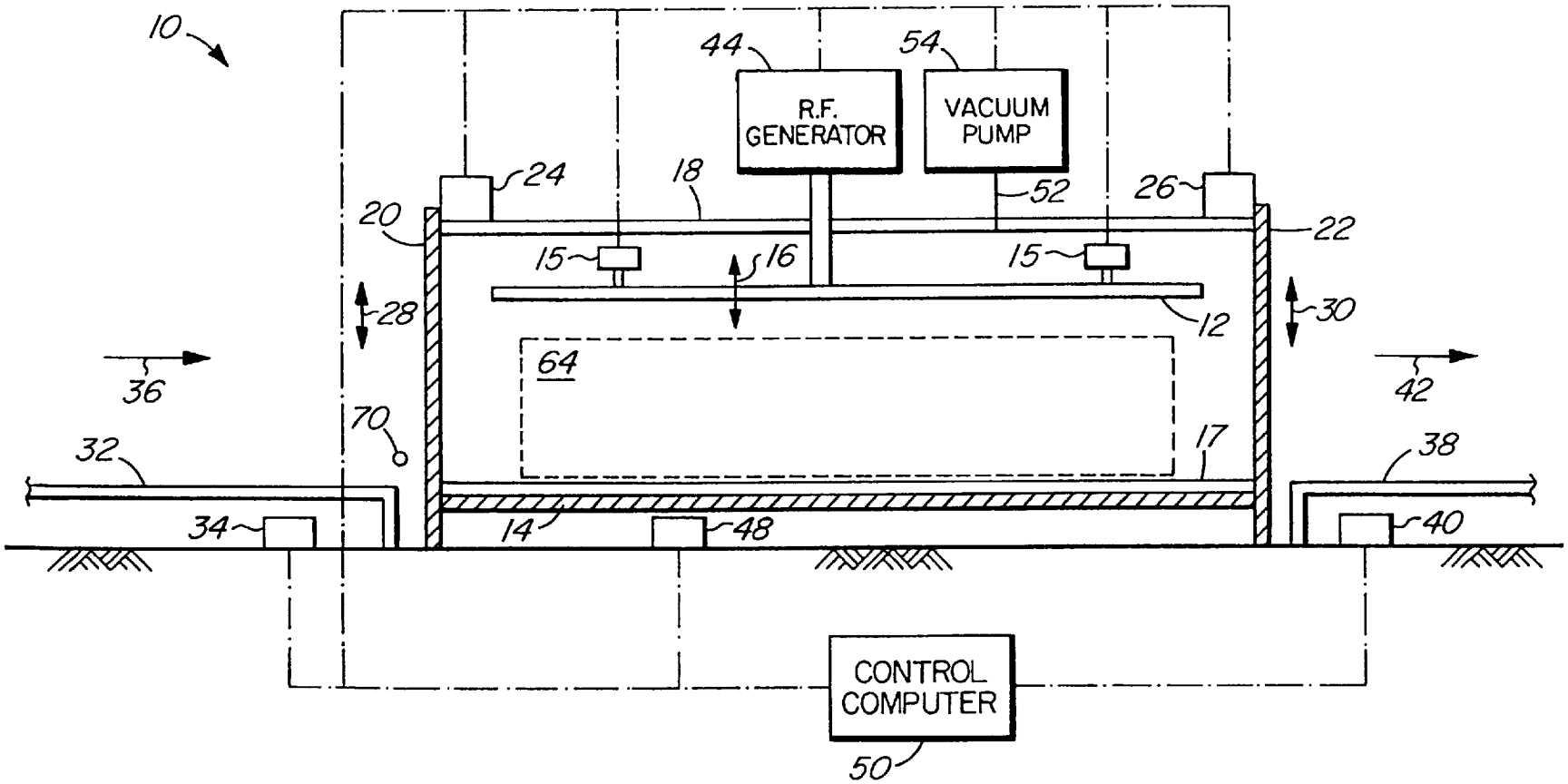
FIG. 1 is a schematic illustration of the kiln conveyor system of the present invention.

The present invention is applied to a dielectric type kiln 10 having a top electrode 12 and a bottom electrode 14. The top electrode 12 is movable as indicated by the arrow 16 preferably by suitable hydraulic means or the like 15 (other means such as mechanical or pneumatic means may be used in place of the hydraulic means) to an operative position wherein the top electrode 12 is resting on top of and may be used to apply significant pressure to a load (schematically indicated by the dash lines 64). The electrodes 12 and 14 form electrical contact between the load 64 and the top and bottom electrodes 12 and 14 or to release the load 64. Preferably, the kiln 10 is formed by a housing 18 with movable doors 20 and 22 at the inlet end and outlet end respectively of the kiln 10. These doors are preferably moved vertically between open and closed positions by a suitable drive mechanism (preferably hydraulic) schematically illustrated at 24 and 26 to open and close the ends of the kiln 10 as indicated by the arrows 28 and 30.

The bottom electrode 14 incorporates a main conveyor schematically represented at 17 and as will be described in more detail hereinbelow moves material 64 through the kiln 10. An input conveyor 32 driven by a suitable power source or motor 34 moves material 64 into the kiln 10 as indicated by the arrow 36. An output conveyor 38 driven by a motor or the like 40 moves material out of the kiln as indicated by the arrow 42.

Power is supplied preferably by a radio frequency (RF) generation source as schematically represented at 44 to one of the electrodes (the other electrode is grounded). In the preferred arrangement as illustrated, RF power is applied to the top electrode 12 which then applies the electromagnetic energy to the material contained therebetween such as the load of lumber schematically represented by the dashed lines in FIG. 1 indicated at 64.

The conveyor 17 of the bottom electrode 14 is preferably driven by a suitable drive motor 48 and the operation of the kiln 10 including doors 20 and 22, electrode movement, power application and the conveyors 17, 32 and 38 etc. is controlled by a computer 50.

It is also preferred that the kiln 10 be a vacuum-type kiln 10 and thus, the interior of the kiln 10 is connected as indicated by line 52 to a vacuum pump or the like 54 that produces negative pressure, i.e. pressure below atmospheric within the interior of the kiln 10 at the appropriate time and when the doors 20 and 22 are in the closed position.

Normally a proximity switch or the like schematically represented at 70 in FIG. 1 is positioned to sense the ends of the new load 64 about to be delivered to the kiln 10, facilitating centering the load in the kiln 10 or alerts the control computer or the like 50 that no new load is being introduced and thus not to initiate a new cycle.

Figure 1A:
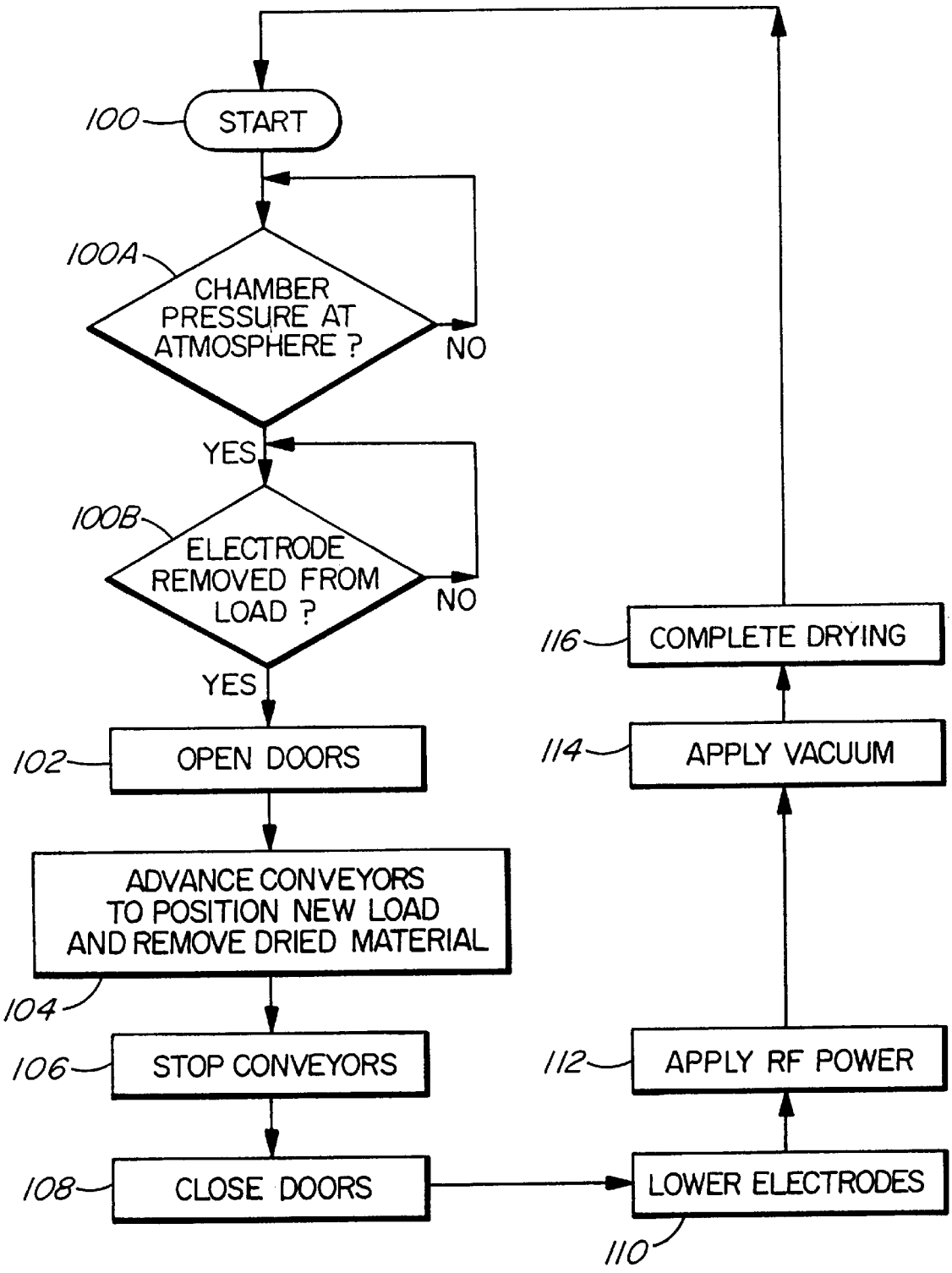
FIG. 1A is a schematic flow diagram of the computer control system forming part of the present invention.

In operation, as illustrated by the flow diagram in FIG. 1A assuming that there is a load waiting on the infeed conveyor 32 and a dried load on the conveyor 17 of bottom electrode 14, the system control sequence is started as indicated at 100, (assuming pressure in the kiln 10 is atmospheric as indicated at 100A and the load 64 has been released i.e. electrode 12 separated from the load 64 as indicated at 100B) the doors 20 and 22 are opened by the motors 24 and 26 as indicated at 102, the conveyors 17, 32 and 38 are activated by activating their respective motors 34, 48 and 42 to introduce a new load on conveyor 32 onto the conveyor 17 and into the kiln 10 and reject the old load from the kiln 10 on the conveyor 17 onto the conveyor 38 as indicated at 104 in FIG. 1A. When the new load 64 is in position on the bottom electrode 14, the conveyors 17, 32 and 38 are stopped as indicated at 106 and then the doors 20 and 22 are moved to close position by their activating motors 24 and 26 to seal off the kiln as indicated at 108. The top electrode 12 is moved by the hydraulic cylinders or the like 15 to apply the required pressure to the top of the new load 64 as indicated at 110 (before, after or during closure of the doors 20 and 22) and then RF power at the desired frequency is applied to the load 64 through the electrode 12 by starting the RF generation source 44 as indicated at 112. If below atmospheric pressure is to be applied, the vacuum pump 54 is activated as indicated at 114.

When drying is completed which may be determined by known methods as indicated at 116, the systems returns to the start position 100 and the cycle repeated.

It will be apparent that while drying is being carried out the dried load is removed from the outfeed conveyor 38 and a fresh load is applied to the infeed conveyor in preparation for the next cycle.

These signals governing the operation of the system are delivered between the various operating elements and the control computer or the like 50 via control lines indicated as dot-dash lines 51 in FIG. 1.

After the drying has been completed, the RF power generator 44 is turned off, the hydraulics 15 actuated to relieve the pressure between the electrodes 12 and 14 to bring the system back to the initial or start position 100 and the cycle repeated if the sensor 70 detects that a new load is being introduced to the kiln 10 when the dried load is being removed.

It will be apparent that by having a conveyor of the bottom electrode permits automation of the system.

Figure 2A:
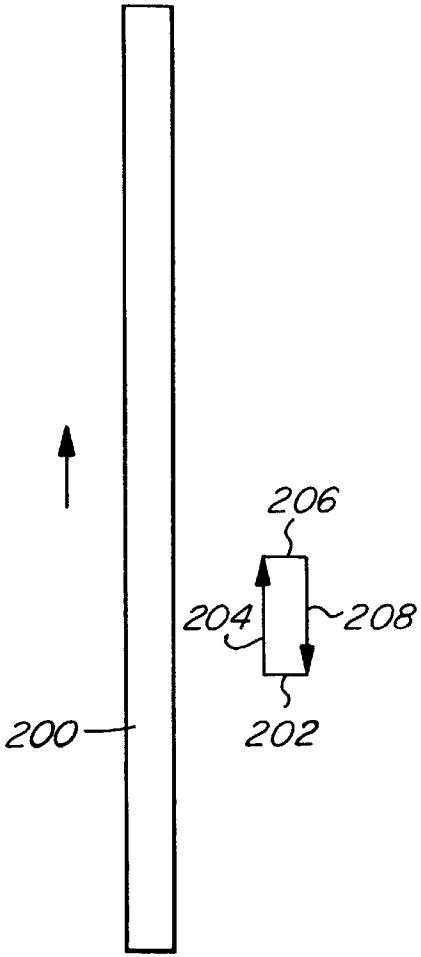
FIG. 2A is a side elevation with parts omitted, primarily showing the path of travel of alternate slots, slats of the slat conveyor of FIG. 2.
Figure 2:
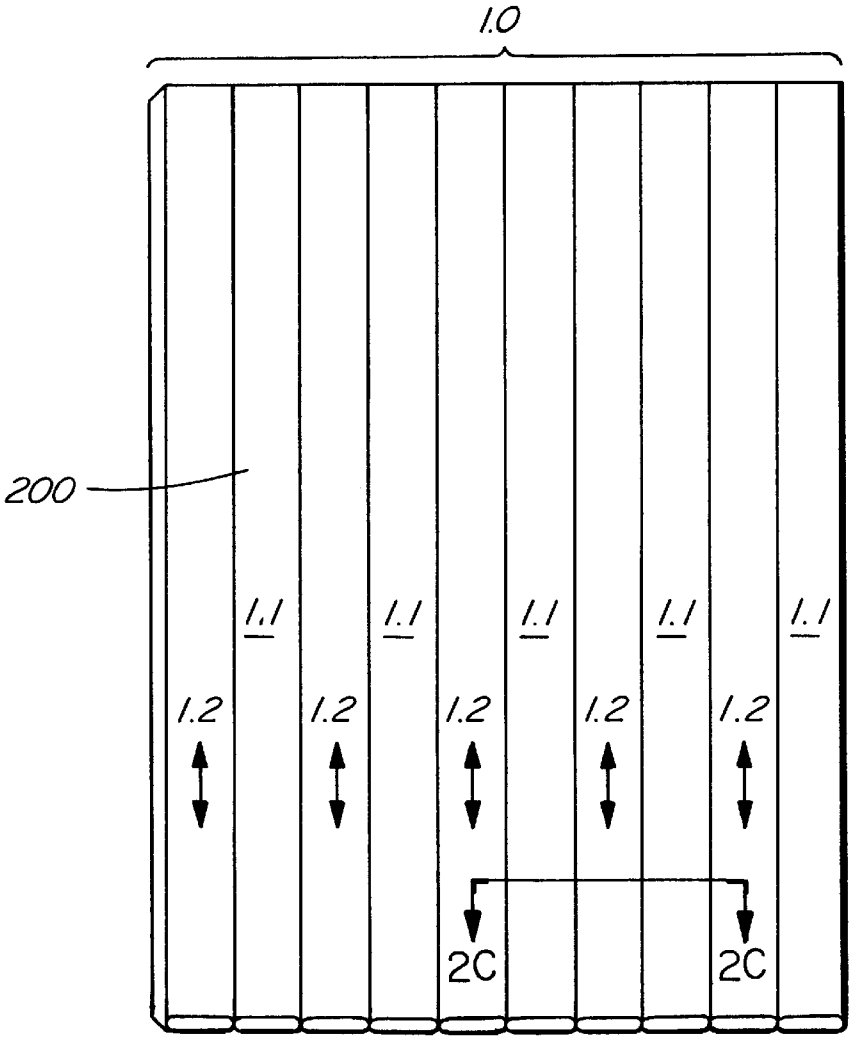
FIG. 2 is a schematic plan view of a slat conveyor suitable for use in the present invention.
Figure 2B:
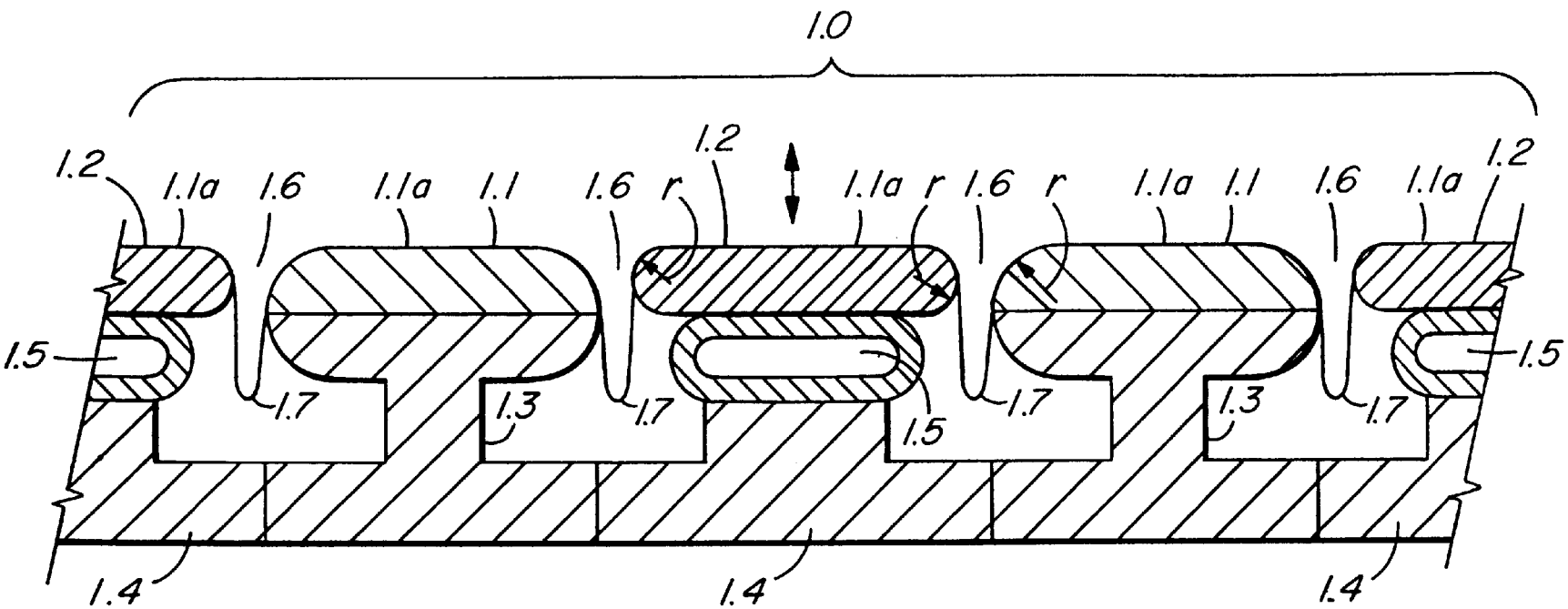
FIG. 2B is a section along the line 2C—2C of FIG. 2 schematically illustrating the mounting of the slats.

A first embodiment of the conveyor 17 for the bottom electrode 14 is shown in FIGS. 2, 2A and 2B. A group of slats 1.0 form the conveyor 17 in this embodiment. The group of slats 1.0 is composed of alternating fixed slats 1.1 and reciprocating slats (1.2) each with a flat horizontal top surface 1.1*a* of electrically conductive material, preferably aluminum which forms the support surface 200 of the bottom electrode 14. In the schematic illustration of FIG. 2B, the fixed slats 1.1 are mounted on fixed rigid supports generally indicated as I-beam type structures 1.3. The reciprocating or mobile slats 1.2 are mounted on axially reciprocating support plates 1.4 via pneumatically expandable bags 1.5 which elevate the top surfaces of the slats 1.2 above those of slats 1.1 as will be described below.

The drive 48 for the conveyor 17 with the embodiment of FIGS. 2, 2A and 2B reciprocates the support plates 1.4 and inflates and deflates the bags 1.5, to move all of the slats 1.2 to follow the pattern shown in FIG. 2A by first lifting the slat 1.2 as indicated at 202 by inflating the bag 1.5, then moving the support plate 1.4, bag 1.5 and slat 1.2 axially toward the outlet end of the kiln 10 as indicated at 204. The bag 1.5 is then deflated as indicated at 206 to rest the load 64 on the slats 1.1 and then the supports 1.4 etc. are moved back to their starting position as indicated by arrow 208.

It will be noted there are gaps 1.6 between adjacent slats 1.1 and 1.2 at the electrode forming surface 200. Optimal drying uniformity occurs when the gaps 1.6 are minimized i.e. preferably to a width of less than 10% of slat width provided all the slats are well grounded together (same potential) preferably with straps.

All edges of the conductive material of the electrodes must be filleted with a radius r sufficiently large to prevent electric field breakdown ($E_{BD}$). For example, the edges of slats 1.1 and 1.2 are filleted with a radius r (See FIG. 2B).

At the frequencies normally used for lumber drying, $E_{BD}$ commences to occur at approximately 10,000Volts/cm (V/cm) with ideal clean, dry high vacuum conditions and may be reduced by 50% with less than ideal conditions typically seen.

It is possible, knowing the conditions to be applied, to determine the maximum voltage level ($V_{MAX}$) that the top electrode 12 will encounter. This information permits determining the applied electric field between the electrodes 12 and 14 which is a function of $V_{MAX}$ and the separation (D) between the electrodes 12 and 14.

Generally, the minimum radius r will be at least $$r>=\tfrac{1}{5}\{[(E_{BD})(D)V_{MAX}]-22\}$$

Where r and D are in centimeters (cm)

$V_{MAX}$ is in volts $E_{BD}$ is in volts/cm Generally this means that for typical higher power applications seen in lumber drying implementations the minimum radius r will be greater than 0.035 cm and r will normally be large.

A plurality of flexible electrical leads or straps (1.7) between all the conductive surfaces 1.1*a* of the reciprocating and stationary slats 1.2 and 1.1.and/or stationary frame members provides the required electrical grounding for this application. Optimal electrical grounding is accomplished with low inductance (wide thickness and short length) conductive straps (1.7), preferably aluminum. The axial separation between electrical grounding leads or straps should be small compared to the radio-frequency wavelength and as a general guidance for the purposes of this invention it must be less than 5% of the wavelength, more practically less than 1% of the wavelength. For example, given a RF wavelength of 44.2 meters (6.78 Mhz operating frequency), the distance between grounding leads or straps must be less than 2.21 meters to prevent major problems and optimally less than 0.442 meters.

While a specific type of slat conveyor has been described, most slat type conveyors may be used as the top or supporting surface 200 of the bottom electrode 14 and thus any such conveyor with appropriate load supporting and electrode forming surfaces could be used.

Examples of such types of conveyors are described in U.S. Pat. Nos. 2,973,856; 3,534,875; 3,815,726; 4,143,760, 4,144,963, and 4,184,587; 4,492,303; 4,856,645; 5,156,259; 5,482,155 & 5,540,322; or 5,588,522.

U.S. Pat. No 3,838,769 describes another form of conveyor that could be applied and employs a "lift & lay" principle that does not necessary have to use longitudinal slats.

U.S. Pat. No. 3,850,287 describes a slightly different approach to the two-slat group conveyor from the "walking beam" family for moving very heavy objects through hostile environments. That with suitable modifications would be suitable for the present invention.

In the arrangements shown in FIGS. 3 to 6 inclusive, the load 64 is conveyed with a plurality of electrically conductive rollers 2.1, preferably aluminum, mounted into their respective slots 2.1*a* in a stationary frame 2.2 with a conductive top support electrode surface 300, preferably made of aluminum.

Figure 3:
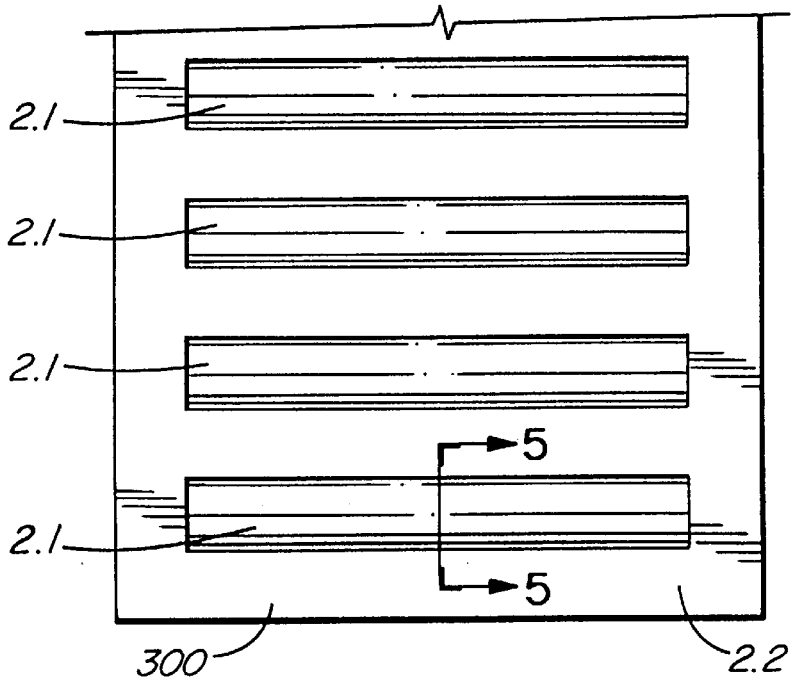
FIG. 3 is a plan view of a roller conveyor forming the conveyor of the bottom electrode.
Figure 4:
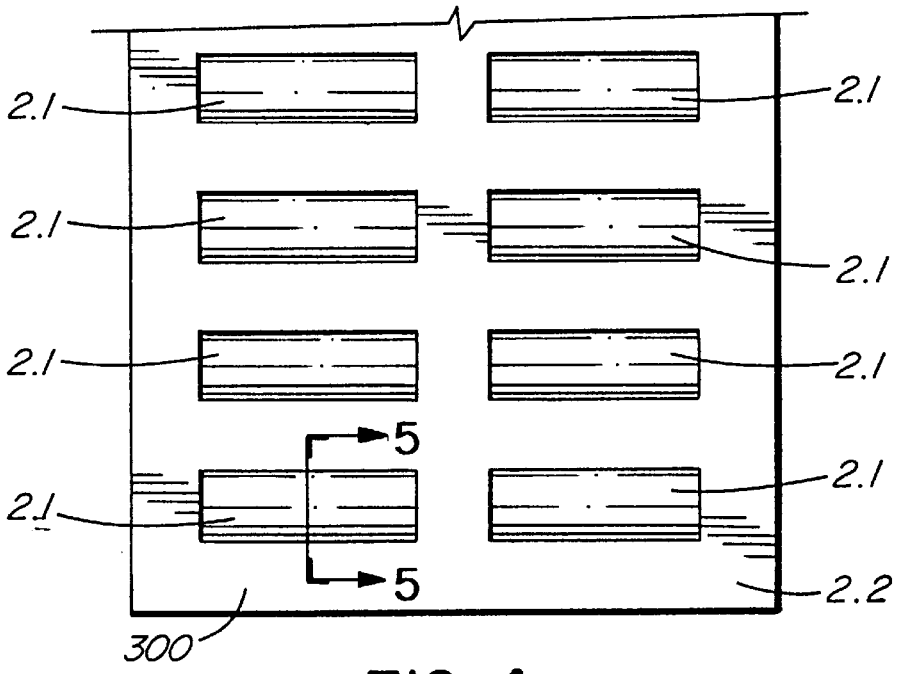
FIG. 4 is a modification of the roller conveyor shown in FIG. 3.

In the FIG. 3 embodiment, the rollers 2.1 extend substantially the full width of the electrode surface 300, while in FIG. 4 a plurality of shorter rollers 2.1 are required to span the width of the surface 300. It is apparent that countless configurations are possible.

In the illustrated arrangement, a plurality of pneumatic devices such as air bags (2.3) are positioned below the rollers so that when the bags 2.3 are inflated, the top surfaces of the rollers 2.1 are in contact with the load 64 i.e. are temporarily elevated to a level slightly above the horizontally flat electrode surface 300 on top of the frame as indicated in dash lines at 2.4 (see FIG. 5). The bags 2.3 are inflated and deflated to raise and lower the rolls 2.1 pneumatically under the control of the computer 50 through the use of solenoid valves and a remote compressed air source (not shown). Once elevated, the load 64 is conveyed by the rotating rollers that are driven with a rubber-surface belt/friction drive (2.5) or one of many other common roller drive systems known to the art.

To ensure optimum uniformity of the electromagnetic fields, the top surfaces of the rollers 2.1 may be fully retracted down so the conveyed load 64 rests in direct contact with the top surface 300 of the stationary frame. Also, when the rollers are fully retracted, the bottoms of the rollers are electrically grounded against and mechanically supported by support members 2.2 as indicated at 2.6 in FIG. 5.

The edges of the stationary supporting electrode surface 300 at the top of the slots 2.1*a* in which the rollers 2.1 are received are filleted with fillets having a radius $r_2$ of essentially the same size as described above for radius r to minimize the non-uniformity of electric field intensities at the surface 300 and prevent electric field breakdown ($E_{BD}$).

From an electromagnetic field perspective, the bottom electrode surface such as the surfaces 200 or 300 should be perfectly flat to ensure optimum power distribution for uniform drying conditions. FIG. 5 shows a gap width d1 i.e. distance from the center of the roller 2.1 to the adjacent side of its receiving slot 2.1*a*. The wider the width d1 the more negatively the electromagnetic field and drying uniformity may be affected. In many cases where the supporting structure and all edges are filleted at radius r as above described, it is not expected that any catastrophic problems will be encountered even with a large $d_1$.

While not specifically illustrated in the drawings, it is clear that other configurations or components can be associated with this embodiment of the invention. For example, a plurality of roller configurations (FIGS. 3 and 4) can be used, vertical movement of the rollers can be accomplished by a variety of methods, and rotation of the rolls can be accomplished through a variety of methods known to the art such as friction drive, chain drive, hydraulics, etc.

The preferred designs for roller conveyors apply solid grounding of the rolls in the holders and use the smallest diameter rolls determined in the same manner as the radius r described above.

It is apparent that if desired, the rollers can be vertically fixed and the entire floor (electrode 300) vertically adjustable i.e. when the load movement is complete, the floor 300 can be pushed upwards against the load 64 and brought in direct contact with all the rollers 2.1 (for electrical grounding).

Figure 5:
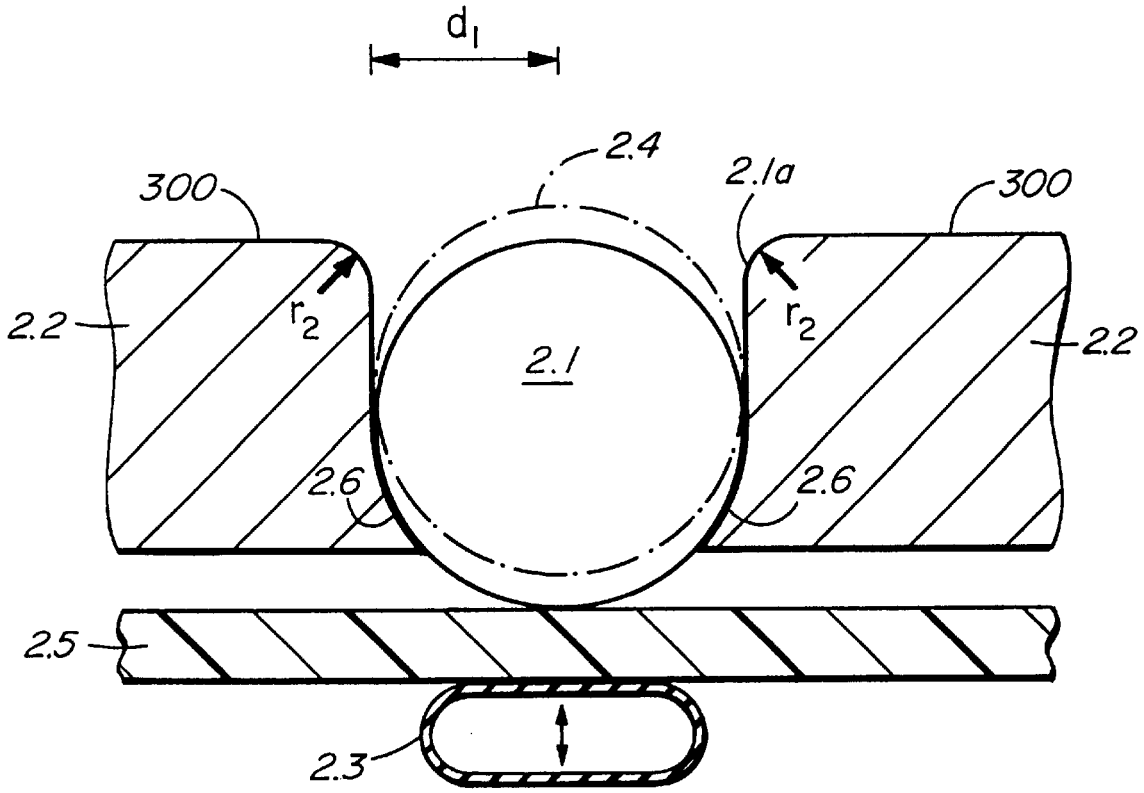
FIG. 5 is a section along the line 5—5 of FIG. 3 or 4 schematically illustrating the roller mounting arrangement.

It is also possible to construct the whole of the electrode surface with rollers so that no raising and lowering is required, however the arrangement of FIG. 5 is preferred. When the total surface of the electrode 300 is formed by rollers, electrical grounding the rollers is the biggest problem as attempting to electrically ground the rollers through bearings alone on each end of the rollers will cause arcing. Although not as highly recommended as direct solid electrical contacts, a number of moving contacts methods known to the art can achieve adequate grounding, such as spring-finger contacts, knife, or sliding.

U.S. Pat. No. 4,593,810 shows one embodiment of how vertically adjustable rollers could be mounted on the electrode.

Figure 6:
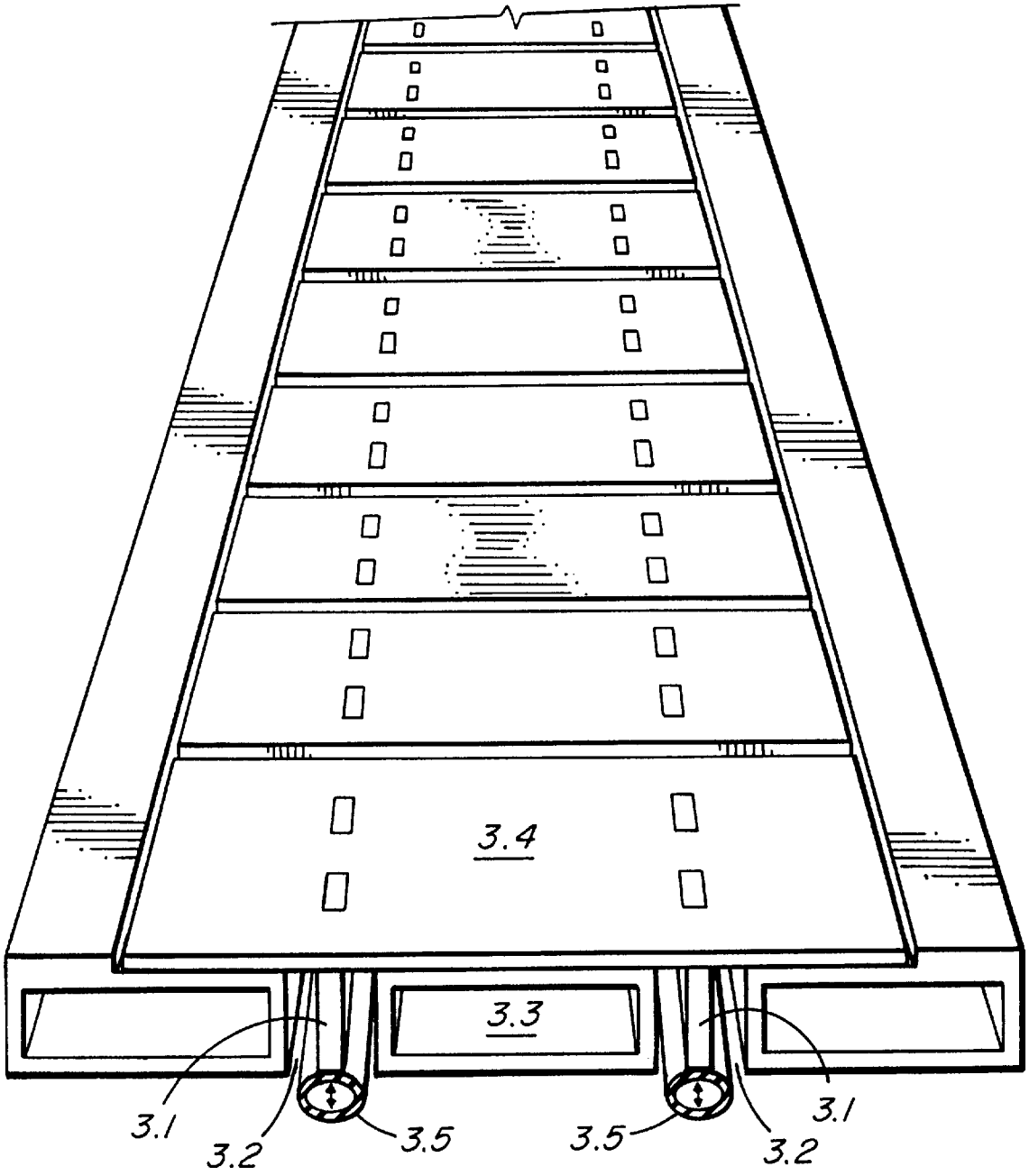
FIG. 6 is an isometric view of a flight-type conveyor employing flights with planer surfaces that form the electrode surface of the bottom electrode when the bottom electrode is functioning as an electrode.

In the embodiment shown in FIG. 6, movement of the load 64 on the electrode is achieved through the use of one or more groups of roller chains (3.1) and their drive units placed in lengthwise channels (3.2) of the stationary supporting electrode (3.3) of the drying chamber. A plurality of conductive plates or slats (3.4), preferably made of aluminum, are mounted on the roller chain links 3.1.

Vertical movement of the chain drive unit is achieved through the use of a plurality of pneumatic devices such as air bags 3.5 placed beneath the roller chain drive units 3.1. The roller chain drive units are automatically raised and lowered pneumatically through the use of solenoid valves and a remote air compressor source under the control of the computer 50.

A number of configurations of columns of slats can be used in this design. For instance, FIG. 6 shows a single column of slats driven by two spaced groups of roller chains. Dependant on the width of the chamber and its capacity, it could also be a reasonable design to have two columns of slats running the width of the electrode with each slat column driven by three groups of roller chains (total: six roller chain groups). It is also possible to have eight slat columns running the length of the chamber and each slat column powered by a single roller chain (total: 8 roller chain groups). Etc.

Figure 7:
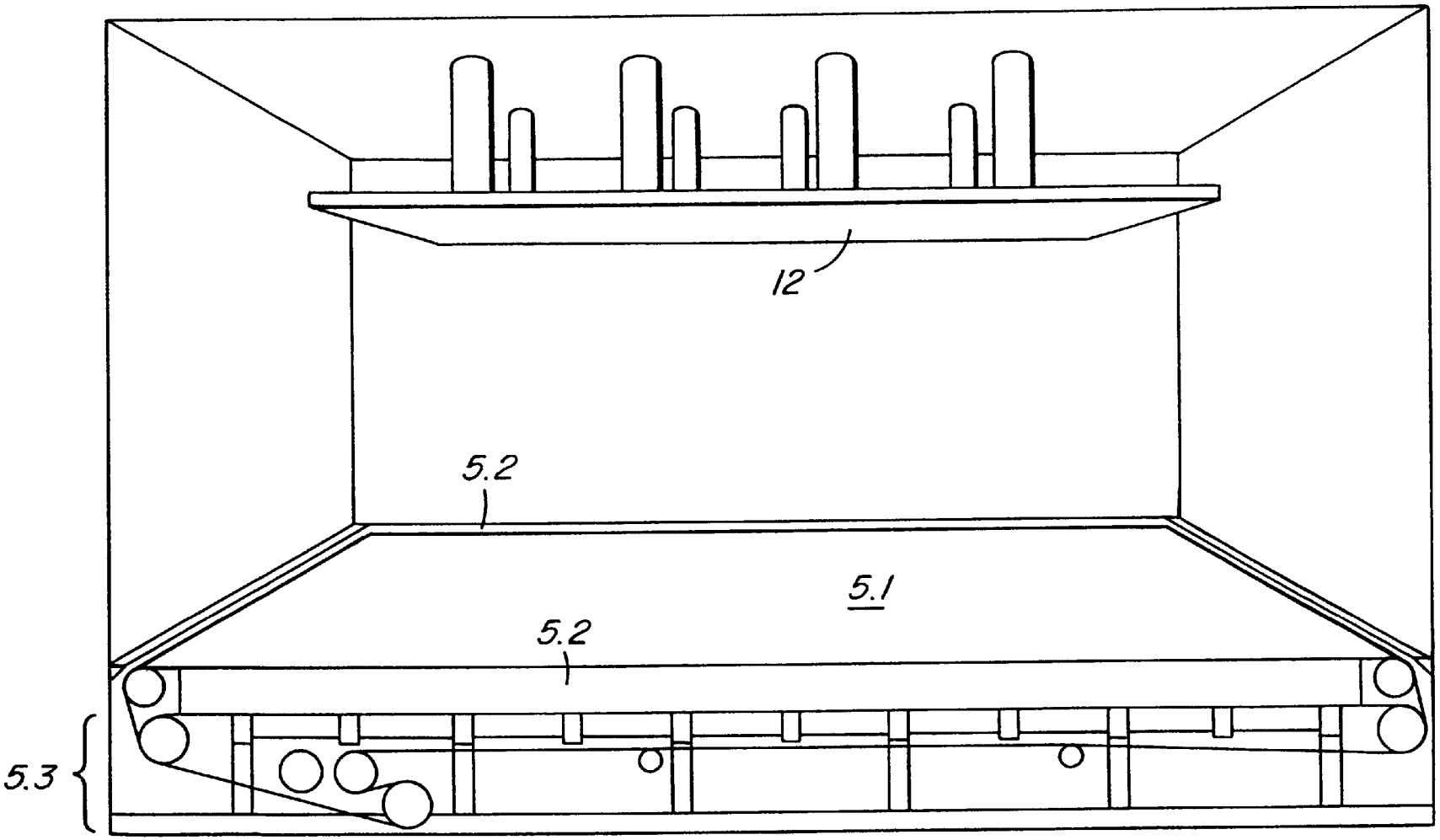
FIG. 7 is an isometric view of a belt conveyor applied to the bottom electrode and showing the travel of the belt conveyor over and under the bottom electrode.

A belt conveyor 5.1 is used as the conveyor 17 in the embodiment shown in FIG. 7. The conveying surface of the belt (5.1) moves the load 64 over top a flat horizontal supporting electrode (5.2) of electrically conductive material, preferably aluminum that forms the bottom electrode 14. The looped belt returns back below the electrode (5.3).

In choosing a suitable belt material, consideration must be given to the material's behavior in intense time varying electric fields. The quantities that characterize the relevant properties of the material with respect to electromagnetic fields are its relative permittivity and its loss tangent. The permittivity determines the electric field enhancement factor that occurs when the electric field is normal to the interface between two materials of different permittivities. The electric field is greater in the medium of smaller permittivity by the ratio of the permittivities. For large electric fields, this can lead to electric breakdown in the less dense medium, a phenomenon referred as imperfect discharge. The optimum choice of belt permittivity would be the value that the wood has when it is dried to its lowest moisture content, as this is when the highest electric fields are encountered during the dielectric drying process. The roll diameters and all edges inside the electric field are subject to the same considerations described above for radius r.

Also during this process, it is important that the belt under the wood does not heat up appreciably. To ensure that the belt is not heated, the belt material must possess a low loss tangent—less than 0.005 preferably less than 0.0005 at the RF frequency of operation. Other unique requirements of a suitable belt include being non absorbent to water and/or by-product condensates from the drying process, able to withstand temperatures in excess of 150 deg. F., able to withstand very high tensile, and able to withstand a high compressive force.

This design embodies belt drive concepts well known to the art in addition to some very specific belt/electrical consideration necessary for our invention.

Having described the invention, modifications will be evident to those skilled in the art without departing from the scope of the invention as defined in the appended claims.

We claim:

1. A dielectric drying kiln suitable for drying lumber and/or material requiring similar power application comprising a computer control, a bottom electrode and a top electrode each having a substantially horizontal electrode surface, means for applying power to said electrodes, said electrodes being vertically spaced to receive material to be dried therebetween and being mounted for relative movement toward and away from each other between a closed operative position wherein said electrodes contact said material over a majority of the surface area of said electrodes and an open inactive position wherein said top electrode is clear of said material, moving means for moving said electrode between said closed operative position and said open inactive position, a main conveyor overlying said bottom electrode and positioned to support and transport said material over said bottom electrode, said main conveyor having at least one moving element, said at least one movable element forming at least a major portion of said surface area of said bottom electrode, said at least one moving element operable to move said material through said kiln in a direction of travel along said bottom electrode under control of said computer control when said electrodes are in said inactive position, a grounding connection electrically connecting said at least one moveable element to said bottom electrode to ensure said at least one moveable element and said bottom electrode are at the same potential, said at least one movable element of said main conveyor forming edges of gaps in said electrode surface of said bottom electrode, said edges of said gaps being filleted with fillets having radiuses and said radius and said gaps being configured with dimensions selected so that said gaps do not significantly affect the uniformity of electromagnetic field and power distribution over said electrode surfaces of said top and bottom electrodes during the application of dielectric power to said material during drying when said electrodes are in said closed operative position and said computer control controlling operation of said kiln including said main conveyor to move said material only while said electrodes are in open inoperative position, said means for moving said electrodes, and to control application of power to said electrodes for drying said material to apply said power only when said electrode are in said closed operative position.

2. A dielectric drying kiln as defined in claim 1 wherein said main conveyor is a slat-type conveyor wherein a plurality of side-by-side slats having upper surfaces that form portions of said electrode surface of said bottom electrode, each said slat having a longitudinal axis substantially parallel to said direction of travel of said material through said kiln and at least one grounding member electrically interconnecting each said slat with its adjacent said slat.

3. A dielectric drying kiln as defined in claim 2 wherein alternate slats of said side-by-side slats are mounted for movement from a starting position to an elevated conveying position, then in said direction of travel, then to a retracted position and then back to said starting position to intermittently move said material through said kiln in said direction of travel.

4. A dielectric drying kiln as defined in claim 3 wherein said gaps are formed between adjacent of said slats and said radius is at least 0.35 cm.

5. A dielectric-drying kiln as defined in claim 4 wherein said kiln is provided with vacuum generating means for reducing the pressure in said kiln during said drying to a pressure below atmospheric pressure.

6. A dielectric-drying kiln as defined in claim 3 wherein said kiln is provided with vacuum generating means for reducing the pressure in said kiln during said drying to a pressure below atmospheric pressure.

7. A dielectric drying kiln as defined in claim 2 wherein said gaps are formed between adjacent of said slats and said radius is at least 0.35 cm.

8. A dielectric-drying kiln as defined in claim 7 wherein said kiln is provided with vacuum generating means for reducing the pressure in said kiln during said drying to a pressure below atmospheric pressure.

9. A dielectric-drying kiln as defined in claim 2 wherein said kiln is provided with vacuum generating means for reducing the pressure in said kiln during said drying to a pressure below atmospheric pressure.

10. A dielectric drying kiln as defined in claim 1 wherein said main conveyor is a roller-type conveyor formed by a plurality of spaced roller having their longitudinal axes substantially perpendicular to said direction of travel through said kiln, a plurality of slots in said bottom electrode one to receive each of said rollers, each of said rollers being movable mounted in its said slot for movement between a retracted position with said roller positioned below an upper surface of said bottom electrode and an active position with at least a portion of the periphery of said rollers above said upper surface for transport of material along said bottom electrode in said direction of travel.

11. A dielectric-drying kiln as defined in claim 10 wherein said upper surface of said bottom electrode directly contacts said material during said drying.

12. A dielectric-drying kiln as defined in claim 10 wherein said kiln is provided with vacuum generating means for reducing the pressure in said kiln during said drying to a pressure below atmospheric pressure.

13. A dielectric drying kiln as defined in claim 1 wherein said main conveyor comprises a flight-type conveyor and said at least one element comprises a plurality of side-by-side conveying elements with planer support surfaces and their longitudinal axes substantially perpendicular to said direction of travel, links interconnecting said conveying elements to form said flight type conveyor, said planer support surfaces being positioned in side-by-side relationship and said gaps are formed between adjacent said planer support surfaces of adjacent of said conveying elements.

14. A dielectric drying kiln as defined in claim 1 wherein said main conveyor comprises a belt-type conveyor extending substantially the full length of said bottom electrode and wherein belt receiving slots are provided through said bottom electrode adjacent to each longitudinal end of said bottom electrode to receive a belt of said belt type conveyor, said belt extending along an upper surface of said of said bottom electrode between an input adjacent to one longitudinal end of said bottom electrode and an output end adjacent to an opposite longitudinal end of said bottom electrode relative to said one longitudinal end, turning rollers positioned in said belt receiving slots to direct said belt through its said belt receiving slot, said turning rolls forming said at least one moveable element, said computer controlling movement of said belt to move said belt in said direction of movement along said upper surface from said inlet end to said outlet end and returning said belt along a return path below said bottom electrode from adjacent to said outlet end to adjacent to said inlet end.

15. A dielectric-drying kiln as defined in claim 14 wherein said kiln is provided with vacuum generating means for reducing the pressure in said kiln during said drying to a pressure below atmospheric pressure.

16. A dielectric drying kiln as defined in claim 14 wherein said radius is at least 0.35 cm.

17. A dielectric-drying kiln as defined in claim 16 wherein said kiln is provided with vacuum generating means for reducing the pressure in said kiln during said drying to a pressure below atmospheric pressure.

18. A dielectric-drying kiln as defined in claim 1 wherein said kiln is provided with vacuum generating means for reducing the pressure in said kiln during said drying to a pressure below atmospheric pressure.

19. A dielectric drying kiln as defined in claim 1 wherein said radius is at least 0.35 cm.

20. A dielectric-drying kiln as defined in claim 19 wherein said kiln is provided with vacuum generating means for reducing the pressure in said kiln during said drying to a pressure below atmospheric pressure.

* * * * *

UNITED STATES PATENT AND TRADEMARK OFFICE

CERTIFICATE OF CORRECTION

PATENT NO. : 6,080,978
DATED : June 27, 2000
INVENTOR(S) : Blaker et al.

It is certified that error appears in the above-identified patent and that said Letters Patent is hereby corrected as shown below:

Column 6,
Line 2, the formula reading "$r>=1/5\{[(E_{BD})(D)V_{MAX}]-22\}$" should read -- $r>=1/\{5[(E_{BD})(D)/V_{MAX}]-22\}$ --

Signed and Sealed this

Fifth Day of October, 2004

JON W. DUDAS
*Director of the United States Patent and Trademark Office*